United States Patent [19]

Howard et al.

[11] 4,015,561

[45] Apr. 5, 1977

[54] ANTI-GRAVITATIONAL CASCADE DEVELOPMENT FOR ELECTROSTATIC PROCESSORS

[75] Inventors: Willard L. Howard, Marion; Ryland F. Rogers, Webster, both of N.Y.

[73] Assignee: Xerox Corporation, Stamford, Conn.

[22] Filed: Dec. 12, 1974

[21] Appl. No.: 532,084

[52] U.S. Cl. ..... 118/654; 427/18; 118/657

[51] Int. Cl.[2] ..... G03G 13/09

[58] Field of Search ..... 118/637; 355/3 DD; 427/18, 20, 21, 14

[56] References Cited

UNITED STATES PATENTS

| | | | |
|---|---|---|---|
| 3,157,546 | 11/1964 | Couer | 427/21 |
| 3,641,980 | 2/1972 | Bickmore | 355/3 DD |
| 3,685,486 | 8/1972 | Donalies | 118/637 |
| 3,707,947 | 1/1973 | Reichart, Jr. | 118/637 |
| 3,752,119 | 8/1973 | Matkan | 118/DIG. 23 |
| 3,826,672 | 7/1974 | Cantarano | 355/3 DD |
| 3,835,811 | 9/1974 | Eto | 118/637 |
| 3,900,001 | 8/1975 | Fraser et al. | 118/637 |

*Primary Examiner*—Mervin Stein

[57] ABSTRACT

Latent electrostatic images carried by a photoconductively coated substrate of an electrostatic processor are developed in a magnetic field free development zone by a multicomponent developer. The developer circulates in a path which runs from a lower level of a sump, upwardly through the development zone, and then back to the sump. To that end, there are means below the development zone for propelling the developer upwardly into and through that zone, together with means above the development zone for capturing the excess developer (i.e., the developer not consumed in the development process) emerging from that zone. In one embodiment, there are separate magnetic transport rolls for propelling the developer into the development zone and for recapturing the excess developer. To accomodate that embodiment, a developer containing ferromagnetic carrier particles and toner particles is used. That embodiment may be enhanced by employing a development electrode to improve the solid area coverage, and that electrode may be appropriately biased to hold background development at an acceptable low level.

11 Claims, 1 Drawing Figure

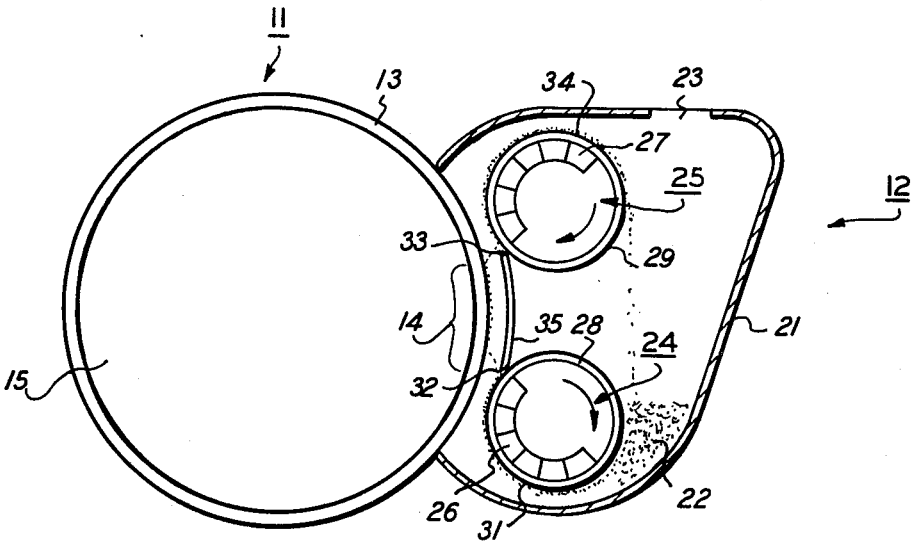
11
13
34
23
27
25
12
33
29
14
35
28
24
21
15
32
26
31
22

ANTI-GRAVITATIONAL CASCADE DEVELOPMENT FOR ELECTROSTATIC PROCESSORS

BACKGROUND OF THE INVENTION

This invention relates to development systems for electrostatic processors and, more particularly, to development systems for providing a magnetic field free development zone with an anti-gravitational flow of a multi-component developer.

In a conventional electrostatic printing process of the type described in Carlson's U.S. Pat. No. 2,297,691 on "Electrophotography", a uniformly charged photoreceptor is selectively discharged in an image configuration to provide a latent electrostatic image which is then developed through the use of a finely divided, electroscopic marking material, called "toner". As is known, that process has enjoyed outstanding commercial success, especially in plain paper copiers and duplicators. Nevertheless, substantial effort and expense are still being devoted to the perfection of the process, including the development step.

The modern practice is to carry out the development step on the fly — viz., as the photoreceptor moves through a development zone. There are various techniques for accomplishing that, but experience has shown that development systems which employ a multi-component developer are generally superior. As a matter of definition, of course, a "multi-component developer" contains relatively large or coarse "carrier" particles in addition to the aforementioned toner particles. Characteristically, the materials for the toner and carrier (or, sometimes, carrier coating) components of such a developer are selected from different positions in the triboelectric series so that advantage can be taken of a triboelectric charging process to induce electrical charges of opposite polarities on the toner and carrier particles. Moreover, triboelectric ranking is taken into account during the selection of those materials since the objective is to have the polarity of the charge triboelectrically imparted to the toner particles oppose the polarity of the charge of the latent images which are to be developed. Consequently, in operation, there are competing electrostatic forces acting on the toner particles. Specifically, the toner particles in any given unit of developer are at least initially attracted to the carrier particles, but are subject to being electrostatically stripped therefrom whenever that unit of developer is brought into the immediate proximity of or actual contact with an image bearing photoreceptor.

There are some situations which call for an upward or anti-gravitational flow of developer through the development zone. Others have previously recognized that so-called magnetic brush development systems may be used to accomplish that, but those systems necessarily have a substantial magnetic field in the development zone. Indeed, it is that field which causes the developer flowing through the development zone to collect in bristle-like stacks or, in other words, to form one or more magnetic brushes. As will be appreciated, magnetic brush development systems have recently gained widespread favor, principally because they can provide excellent solid area coverage at acceptably low background development levels. Nevertheless, those systems still require a very delicate balance to achieve that while avoiding excessive wear of the developer, streaking of the developed image, or unacceptably high levels of magnetic interference with nearby parts of the processor, all as described in more detail in U.S. Pat. No. 3,906,121 to Fraser et al., issued Sept. 16, 1975. That application is specially relevant to the subject matter under consideration here and it is, therefore, hereby incorporated by reference.

SUMMARY OF THE INVENTION

An object of this invention is to provide an alternative to magnetic brush development systems for those situations which call for an upward or anti-gravitational flow of a multi-component developer through a development zone.

More particularly, an object of the present invention is to provide methods and means for maintaining an anti-gravitational flow of a multi-component developer through a magnetic field free development zone. A detailed, related object is to provide methods and means which are not only capable of accomplishing that, but which also are less sensitive than magnetic brush development systems to variations in the thickness of the developer entering the development zone and less prone than magnetic brush development systems to causing streaking of the developed images.

To carry out these and other objects of the invention, a multi-component developer is circulated in a path which runs from a sump, upwardly through a magnetic field free development zone, and then back to the sump. There are means for propelling the developer upwardly into the development zone with sufficient velocity to cause the excess developer (i.e., the developer not consumed in the development process) to emerge from the upper side of the development zone, together with means for capturing the emerging developer and returning it to the sump. In one embodiment, there is a first magnetic transport roll for propelling the developer upwardly into the development zone and a second magnetic transport roll for capturing the developer emerging from the development zone. To accomodate that embodiment, a developer comprising ferromagnetic carrier particles and toner particles is used. That embodiment may be enhanced by employing a development electrode which is biased to achieve improved solid area coverage while holding background development at an acceptably low level.

BRIEF DESCRIPTION OF THE DRAWING

Still further objects and advantages of this invention will become apparent when the following detailed description is read in conjunction with the attached drawing, in which:

The FIGURE is a simplified schematic diagram of an electrostatic processor having a development system embodying the present invention.

DETAILED DESCRIPTION OF THE ILLUSTRATED EMBODIMENT

While the invention is described in some detail hereinafter with reference to a single embodiment, it is to be understood that there is no intent to limit it to that embodiment. On the contrary, the goal is to cover all modifications, alternatives and equivalents falling within the spirit and scope of the invention as defined by the appended claims.

Turning now to the drawing, it will be seen that there is an electrostatic processor 11 (shown only in relevant part) having a development system 12 for developing latent electrostatic images carried by a photoreceptor 13 on the fly — viz., as the photoreceptor 13 moves through a development zone 14. In this instance, the photoreceptor 13 is a photoconductive coating on a rotatable drum 15. It will, however, be appreciated that there are other possible processor configurations, including one wherein the photoreceptor is supported by a flexible belt-like substrate and another wherein the photoreceptor is a coating on a specially prepared paper.

Concentrating on the development system 12, it should be noted at the very outset that the development zone 14 is free of any appreciable magnetic field. In view of that, it is especially significant that the latent electrostatic images carried by the photoreceptor 13 are developed by passing a multi-component developer containing triboelectrically charged toner and carrier particles upwardly through the development zone 14. Briefly, to accomplish that, the development system 12 comprises a housing 21 having a sump 22 for storing a supply of developer. And, as described in more detail hereinbelow, provision is made for circulating the developer along a path which runs from a lower level of the sump 22, upwardly through the development zone 14, and then back to an upper level of the sump 22.

Some toner is necessarily consumed in the development process. Specifically, the attractive forces generated by the latent images electrostatically strip toner from the developer passing through the development zone 14 and cause that toner to deposit on the photoreceptor in conformity with the configuration of those images. Accordingly, in keeping with standard practices, there desirably are means (not shown) communicating with an inlet aperture 23 in the housing 21 for adding additional toner to the sump 22 from time to time to thereby maintain the toner concentration of the developer at a suitably high level. The quantity of developer stored in the sump 22 is, in turn, selected to ensure that there is ample opportunity for the developer returning from the development zone 14 to become fully loaded with toner as it descends through the sump 22 in preparation for being recirculated. Hence, the development zone 14 is continuously supplied with developer having a suitably high toner concentration level.

In accordance with this invention, to provide the magnetic field free development zone 14 with an anti-gravitational flow of developer, there are means immediately below the development zone 14 for propelling developer upwardly into and through that zone, together with means immediately above the development zone 14 for capturing the excess developer (i.e., the developer not consumed in the development process) as it emerges from that zone. Here, the developer is propelled by a first magnetic transport roll 24 and the excess developer is captured by a second magnetic transport roll 25. Thus, the preferred developer is a mixture of toner particles and ferromagnetic carrier particles, such as is conventionally employed in magnetic brush development systems.

More particularly, to carry out the invention, the transport rolls 24 and 25 of the illustrated embodiment comprise stationary, multi-pole permanent magnet assemblies 26 and 27 which are supported within rotatable, non-magnetic sleeves 28 and 29, respectively. In this instance, the transport roll 24 serves the dual purpose of transporting developer from the sump 22 and propelling the developer upwardly into the development zone 14. The diameter of the sleeve 28 and the configuration of the magnetic assembly 26 are, therefore, selected so that the transport roll 24 carries developer from a pick-up point 31 in the lower level of the sump 22 to a discharge point 32 directly below the development zone 14. The transport roll 25, on the other hand, captures the excess developer as it emerges from the development zone 14 and then returns it to the sump 22. Accordingly, the diameter of the sleeve 29 and the configuration of the magnetic assembly 27 are selected so that the transport roll 25 carries the excess developer from a pick-up point 33 directly above the development zone 14 to a discharge point 34 located over the sump 22.

In operation, the sleeves 28 and 29 are rotatably driven in the direction of the arrows (clockwise as shown) to circulate the developer into and away from, respectively, the development zone 14. The surface speed of the sleeve 28 is selected so that the developer is released therefrom upon reaching the discharge point 32 with sufficient velocity to pass upwardly into and through the development zone 14. Some of the developer bounces off the photoreceptor 13 while in transit through the development zone 14 and the balance travels in a boundary layer adjacent the photoreceptor 13. Hence, toner deposits on the photoreceptor 13 in conformity with the latent images carried thereby. The excess developer emerging from the upper side of the development zone 14 is magneticaly attracted toward the pick-up point 33 on the transport roll 25. Thus, to prevent developer from building up at that point, the surface speed of the sleeve 29 is selected to be at least as high as, and preferably even higher than, the surface speed of the sleeve 28.

To enhance the development system 12, a development electrode 35, such as is conventionally used in various cascade development systems, may be included. As is known, the development electrode 35 is suitably mounted in the development zone 14 at a predetermined short distance of, say, 0.050 – 0.100 of an inch or so from the photoreceptor 13 and is biased to a voltage between the characteristic voltage levels of the image and non-image or background areas of the photoreceptor. In that event, the development electrode 35 may be relied on to hold the background development at a reasonably low level even if the developer flow rate and toner concentration are optimized for solid area coverage. Additionally, the transport rolls 24 and 25 may be electrically biased to aid in suppressing the free toner which might tend to form an undesirable "powder cloud". Moreover, provision may be made for halting the transport roll 24 slightly before the transport roll 25 when the development system 12 is being shut down to reduce the tendency for developer to fall back downwardly through the development zone 14 when a shutdown occurs.

CONCLUSION

In view of the foregoing, it will now be understood that the present invention provides methods and means for circulating a multi-component developer upwardly through a magnetic field free development zone. In fact, it will be appreciated that this invention effectively provides a cascade development system which is characterized by an uphill or anti-gravitational flow of developer.

What is claimed is:

1. A development system for developing latent electrostatic images carried by an image bearing member with developer including toner particles and ferromagnetic carrier particles as said member moves through a substantially magnetic field free development zone having an upper side and a lower side; said system comprising the combination of a sump for storing a supply of said multi-component developer, first magnetic means positioned between said sump and the lower side of said development zone for feeding developer from said sump and propelling said developer upwardly into and through said development zone, and second magnetic means positioned between said sump and the upper side of said development zone for capturing excess developer emerging from said development zone and returning said excess developer to said sump.

2. The development system of claim 1 wherein the developer is fed from a lower level of said sump and the excess developer is returned to an upper level of said sump, whereby the returning developer dwells in said sump for a finite period of time before being recirculated.

3. The development system of claim 1 wherein image and background areas of said image bearing member have different characteristic voltage levels; and further including a development electrode positioned in said development zone at a predetermined short distance from said image bearing member, and means for biasing said development electrode to a voltage between the characteristic voltage levels of said image and background areas.

4. The development system of claim 1 wherein, said first means includes a first magnetic transport roll for propelling developer upwardly into and through said development zone, and said second means includes a second magnetic transport roll for capturing the excess developer emerging from said development zone.

5. The development system of claim 4 wherein said first transport roll is configured to carry developer from a pick-up point in a lower level of said sump to a discharge point immediately below said development zone, and said second transport roll is configured to carry excess developer from a pick-up point immediately above said development zone to a discharge point overlying said sump.

6. The development system of claim 5 wherein each of said transport rolls includes a stationary, multipole permanent magnet assembly supported within a rotatable, non-magnetic sleeve.

7. The development system of claim 4 wherein image and background areas of said image bearing member have different characteristic voltage levels; and further including a development electrode positioned in said development zone at a predetermined short distance from said image bearing member, and means for biasing said development electrode to a voltage between the characteristic voltage levels of said image and background areas.

8. The development system of claim 7 wherein each of said transport rolls includes a stationary, multipole permanent magnet assembly supported within a rotatable, non-magnetic sleeve, the multi-pole magnet assembly and the sleeve of said first transport roll are configured to carry developer from a pick-up point in a lower level of said sump to a discharge point immediately below said development zone; and the multi-pole magnet assembly and the sleeve of said second transport roll are configured to carry excess developer from a pick-up point immediately above said development zone to a discharge point overlying said sump.

9. An electrostatic processor having a photoconductively coated substrate for carrying latent electrostatic images, a development system for providing an anti-gravitational flow of a multi-component developer through a development zone to develop said images as said photoconductively coated substrate moves through said development zone; said development system having a sump for storing a supply of developer, circulating means for circulating said developer along a path which runs from said sump, upwardly through said development zone, and then back to said sump, said circulating means including a first magnetic means disposed in said path immediately below said development zone for propelling developer upwardly into said development zone with sufficient velocity that the developer remaining after development of said images passes through the development zone, and a second magnetic means disposed in said path immediately above said development zone for capturing the remaining developer as it emerges from said development zone, said first and second magnetic means including magnetic field producing means constructed and located to maintain said development zone substantially free of a development-effecting magnetic field.

10. The electrostatic processor of claim 9 wherein image and background areas of said photoconductively coated substrate have different characteristic voltage levels; and said development system further includes a development electrode positioned in said development zone at a predetermined short distance from said substrate, and means for biasing said development electrode to a voltage between said characteristic voltage levels.

11. The electrostatic processor of claim 10 wherein said developer contains toner particles and ferromagnetic carrier particles, and said first and second magnetic means are respective magnet transport rolls.

* * * * *